United States Patent [19]

Hitt

[11] Patent Number: 5,062,639

[45] Date of Patent: Nov. 5, 1991

[54] SUPPLEMENTARY IMPACT DEVICE FOR A GOLF CLUB

[76] Inventor: Otis H. Hitt, 3520 Gas Lite Dr., Archbold, Ohio 43502

[21] Appl. No.: 551,153

[22] Filed: Jul. 11, 1990

[51] Int. Cl.[5] ..... A63B 69/36; A63B 53/04

[52] U.S. Cl. ..... 273/171; 273/194 B; 273/175; 273/168; 273/167 C

[58] Field of Search ..... 273/167 B, 175, 78, 273/169, 170, 171, 172, 173, 174, 186 A, 168, 194 R, 194 A, 194 B, 167 C, 167 D, 167 F, 167 J

[56] References Cited

U.S. PATENT DOCUMENTS

| | | | |
|---|---|---|---|
| 3,319,964 | 5/1967 | Steinberg | 273/194 A |
| 3,333,854 | 8/1967 | White | 273/167 B |
| 3,437,341 | 4/1969 | Hasten | 273/175 |
| 3,578,332 | 5/1971 | Caldwell | 273/78 |
| 3,727,920 | 4/1973 | Scott | 273/194 AX |
| 4,025,078 | 5/1977 | Pelz | 273/171 X |
| 4,121,832 | 10/1978 | Ebbing | 273/173 X |

FOREIGN PATENT DOCUMENTS

| | | | |
|---|---|---|---|
| 7550 | 4/1900 | United Kingdom | 273/167 B |

*Primary Examiner*—George J. Marlo
*Attorney, Agent, or Firm*—George R. Royer

[57] ABSTRACT

An elongated weighted bar includes a ball stroking front surface and protrusions at the opposite ends of its rear surface. When attached to the striking face of a golf club, the full length of the weighted bar between the protrusions is spaced forwardly of the striking face of the club. The vertical height of the bar is less than the club's striking face and provides a concentrated weight mass along the longitudinal extent thereof.

2 Claims, 1 Drawing Sheet

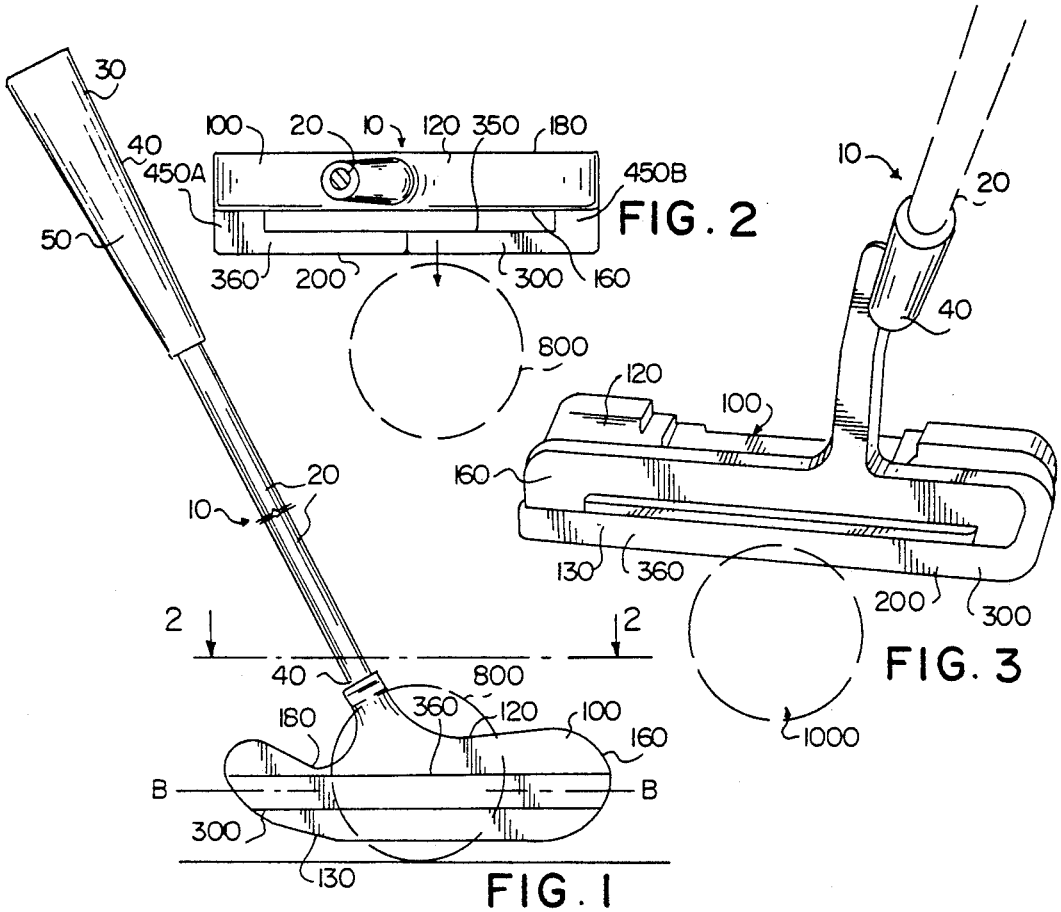
FIG. 2
FIG. 3
FIG. 1
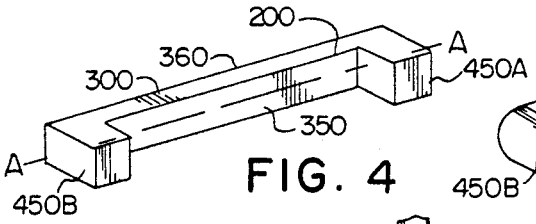
FIG. 4
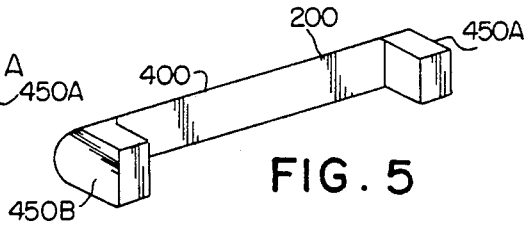
FIG. 5
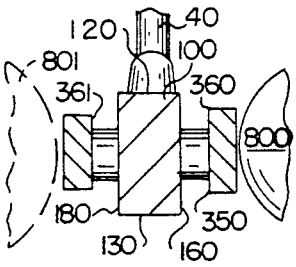
FIG. 6
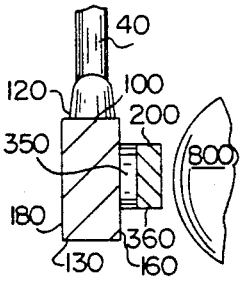
FIG. 7
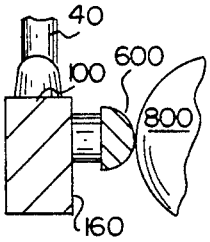
FIG. 8
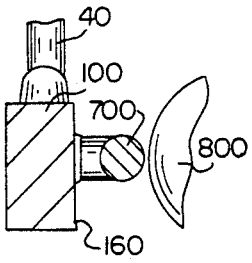
FIG. 9

SUPPLEMENTARY IMPACT DEVICE FOR A GOLF CLUB

DISCUSSION OF PRIOR ART AND BACKGROUND OF INVENTION

The subject invention pertains to the sporting field, particularly to the game of golf. Most specifically, the subject invention is an improvement of a golf putter or other golf clubs, and more particularly is a device that is appended to the frontal face of a golf club so as to provide an additional impact concentraction device in order to enhance the hitting power of the club during the usual stroking process.

One of the problems encountered in using a putter, or other clubs in the gate of golf is the lack of power or momentum encountered when using the putter. The relative size of the hitting surface at the bottom end of the club detracts from the desired property of concentrating the club's impact when the club is swung in an arcuate motion. By providing a concentrated impact surface at the bottom of the club, added power on the swing yields improved hitting results without the necessity of forcing the club movement.

More particularly, when using a putter or club to stroke a golf ball, the momentum, as generated by the weight of the club, and especially the head, imparted to the ball is somewhat limited. One of the causes of such lack of stroking power is the lack of a concentrated striking surface on the golf club head. In this regard, a concentration of the hitting surface on the head will enhance the impact in the ultimate thrust imparted to the ball by the swing of the club. This aspect is equally applicable to all types of golf clubs.

This invention is therefore directed to overcome the foregoing problems and is adapted to provide a supplementary impact feature to a golf club head, and to this end the following objects are directed accordingly.

OBJECTS

The following are objects of the subject invention.

It is an object of the subject invention to provide an improved golf club;

Another object of the subject invention is to provide an improved impact device for a golf club head;

Yet another object of this invention is to provide an improved head for a putter, as used in golfing;

Another object of the invention is to provide an improved apparatus for improving performance of a golf putter;

Still another object of this invention is to improve the stroking power of a golf club;

A further object of the invention herein is to provide an improved golf club head;

Yet another object of the subject invention is to provide an improved surface for a golf club head;

Other and further objects of the subject invention will become apparent from a reading of the following description taken in conjunction with the claims and drawings.

DRAWINGS

FIG. 1 is a side view, in elevation, of a golf club putter showing the posterior side of the club head with the subject apparatus attached;

FIG. 2 is a top elevational view of a golf putter head with the subject apparatus;

FIG. 3 is a perspective view showing a golf club putter with the subject apparatus being affixed to the frontal side of the club head, and also showing partially how a golf ball can be hit with the subject apparatus;

FIG. 4 is a perspective view of the preferred embodiment of the supplementary apparatus;

FIG. 5 is a perspective view of an alternate embodiment of a supplementary apparatus to be affixed to the head of a golf club;

FIG. 6 is an end elevational view of the golf putter head incorporating the preferred embodiment of the subject invention, as shown how the subject apparatus can be affixed to the front or back of a golf club head for left or right-handed usage in putting; thus making the frontal side appear on both sides of the head;

FIG. 7 is an end elevational view of the subject invention showing a first alternate embodiment of the subject invention as attached to the frontal head of a golf club head;

FIG. 8 is an end elevational view of the putter head showing an alternate embodiment of the subject invention;

FIG. 9 is an end elevational view of the putter head showing a third alternate embodiment of the subject invention.

DESCRIPTION OF GENERAL EMBODIMENT AND SUMMARY OF INVENTION

The subject invention is a novel supplementary impact device for golf clubs, and comprises in general a longitudinally extending weighted member adapted to be affixed in a longitudinal manner along either the posterior or frontal side of the face of the club head.

DESCRIPTION OF PREFERRED EMBODIMENT OF THE SUBJECT INVENTION

The invention described herein is only one embodiment of several possible embodiments, and therefore the following description shall not be considered as limiting the scope of the subject invention, as set forth in the claims annexed hereto.

Referring now to the drawings, and particularly FIGS. 1, 2, 3, 4 and 5, in which a preferred embodiment of the subject invention is shown, a golf club 10 incorporating the features of the subject invention is shown. As shown, such golf club 10 is generally conventional in its overall constructional arrangement, and is generally comprised of a longitudinally extending shaft 20, with said shaft having an upper end 30 and a lower end 40. The upper end 30 of shaft 20 is comprised of a handle 50, commonly referred to as the grip, and is generally slightly enlarged relative to the rest of the shaft 10, and usually has a fabric or plastic wrapping therearound for optimal manual grasping purposes. Integrally disposed on the lower end 40 of the shaft 10 is striking head 100. In the embodiment shown in the drawings, the golf club 10 is shown as being a putter, a club that is generally employed for short strokes over the green of a golf course. While the subject invention is shown as being applicable to golf putters, in the total golf club genre, it is to be emphasized that the subject invention is equally applicable to golf clubs of all types, including drivers, irons and wedges. Thus, while the subject invention as described herein is directed to a putter type club, the scope of such application is not to be limited to such a type of club, but may be applicable to golf clubs of all types.

As seen, the head 100 of the putter club essentially comprises an abbreviated substantially perpendicular extension of the lower end 40 of the club shaft 20 and has an upper surface 120 and a lower surface 130. The lower surface 130 is that surface that is oriented closest to the ground when the club 10 is being used and is commonly referred to as the club sole. Moreover, the head 100 has a frontal hitting surface called the face 160, and a posterior surface 180 which opposes the frontal face. The head 100 being a longitudinally extending member, has a longitudinal central axis.

As shown in the drawings, the frontal surface of the head 100 is provided with a supplementary impact device 200, as seen. More particularly, integrally disposed and affixed on the front surface 160 of the head 100 is a longitudinally extending bar member 300, which bar member has a longitudinal central axis extending symmetrically through the longest extent thereof. More particularly, bar member 300 is shown as being a parallelopiped or rectangularly-shaped member, having a frontal surface 360 and a posterior surface 350, as shown in the drawings. At this juncture, it is important to indicate that the shape of the bar member 300 need not be parallelopiped, but rather may be of any shape or configuration, so long as it does not interfere with the function of club 10. Thus, as can be seen in FIG. 8, the supplementary impact device may be rounded in the form of a semi-cylindrical member 600, as shown in FIG. 8, or a full cylindrically-shaped member 700 as shown in FIG. 9.

Moreover, shapes and configurations are envisioned as being within the scope of this invention other than shapes and configurations described above and shown in the drawings. Moreover, it is also to be stressed that the supplementary impact device 200 may be affixed to either the front face 160 or the posterior side 180 of the head 100, as desired, and as shown in FIG. 6 for either left or right-handed striking of the ball.

As shown in FIGS. 1, 2, 3, 4 and 6, the longitudinally extending impact device 200 is preferably affixed to the front side 180 of the club head 100 and is aligned in such a position that the longitudinally extending central axis of impact device 200 is aligned generally and substantially coextensive with the longitudinal central axis of the head 100. This latter relationship is shown in FIGS. 2 and 3.

Attention is now directed to FIGS. 1, 2, 3, 4 and 5. In the preferred embodiment of the subject invention, the impact device 200 is affixed to the frontal face 160 of the head 100 in a spaced offset position. For purposes of offsetting the impact device 200 from the frontal face 160, the impact device 200 is provided with a pair of bar members 450A and 450B adapted to be welded or otherwise permanently affixed to the front face 160 of the head 200 as shown. Another viable method would be to cast the impact device 200 as one integral piece with the head 100, either to the front or back of the head. In the embodiment shown in FIGS. 1, 2. 3 and 6, a golf ball 800 can be hit with the outer surface 360 of the impact device 200, as shown in FIG. 4, or it can be hit with the posterior face 180 of the head, opposite to where the impact device 200 is located. Thus, as stated, in FIG. 6 the supplementary impact device 200 may be affixed directly to posterior face 180 of club head 100 or the frontal face 160. Moreover, shapes and configurations are envisioned as being within the scope of this invention other than the shapes and configurations described above and shown in the drawings.

The subject impact device 200 can be appended to the posterior surface of the head 100, as seen. More particularly, integrally disposed on the posterior surface 180 of the head is longitudinally extending bar member 300, such bar member having a longitudinal central axis. The bar member 300 disposed on the rear face 180 of head 100 is shown as being a parallelopiped member.

In further summary, the subject invention is an apparatus for improving the performance of a golf club having a striking head, which striking head has a striking frontal face and a posterior surface which opposes the frontal striking surface, such apparatus comprising a longitudinally extending bar member, such longitudinally extending bar member having at least a first surface and a second surface which opposes said first surface with said first surface being flat, and which second surface is affixed to the frontal surface of the striking head of such golf club.

In summary, the subject invention is a supplementary impact device for improving the performance of a golf club having a striking head, which striking head has a frontal face and a posterior surface which opposes the frontal striking surface, such device comprising a longitudinally extending bar member, such longitudinally extending bar member having a front surface and a posterior surface, and having a connecting means affixed to the posterior surface of such bar member and additionally connected to the frontal surface of such striking head to connect such longitudinally extending bar member to the frontal face of striking head.

Yet another description of such apparatus is a supplementary device for appendage to a golf putter having a striking head, which striking head has a striking frontal face and a posterior surface which opposes the frontal striking surface, such device comprising a longitudinally extending bar member, such longitudinally extending bar member having at least a first surface and a second surface which second surface opposes such first surface, with such first surface being rounded and which second surface is affixed to the frontal surface of the striking head of such golf putter.

Still another description of the subject invention is a device for improving the performance of a golf club having a striking head, which striking head has a striking frontal face and a posterior surface which opposes the frontal striking surface, such apparatus comprising a longitudinally extending bar member, such longitudinally extending bar member having at least a first surface and a second surface which opposes such first surface, and which second surface is affixed to the frontal surface of the striking head of such golf club.

I claim:

1. A supplementary impact device for improving the performance of a golf club having a striking head, which striking head has a frontal striking face and a posterior face which opposes the frontal striking face, said impact device adapted to be connected to the striking head of the golf club, and comprising:

(a) a longitudinally extending bar member having a longitudinally extending axis, a predetermined height, a frontal surface along the entire length thereof for stroking engagement with a golf ball, and a posterior surface, said predetermined height of said bar member being substantially less than the height of said frontal striking face of said club head to provide a concentrated weight mass along the longitudinal axis thereof to enhance the hitting power of said club during the ball stroking process; and (b) spacing means protruding from the posterior surface of said bar member at opposite ends thereof for connecting said bar member to the frontal striking face of said club head so that said bar member extends over the full length of said head and said bar member is continuously spaced forwardly of the frontal striking face of said club head along the full length of said bar member between said protruding spacing means.

2. A supplementary device for appendage to a golf club as recited in claim 1 wherein said frontal surface of said bar member is rounded.

* * * * *